US009528467B2

(12) United States Patent
Dadd

(10) Patent No.: US 9,528,467 B2
(45) Date of Patent: Dec. 27, 2016

(54) STIRLING CYCLE MACHINES

(71) Applicant: Isis Innovation Limited, Summertown, Oxford (GB)

(72) Inventor: Michael William Dadd, Oxford (GB)

(73) Assignee: Isis Innovation Limited, Summertown, Oxford (GB)

( * ) Notice: Subject to any disclaimer, the term of this patent is extended or adjusted under 35 U.S.C. 154(b) by 217 days.

(21) Appl. No.: 14/371,544

(22) PCT Filed: Jan. 7, 2013

(86) PCT No.: PCT/GB2013/050015

§ 371 (c)(1),
(2) Date: Jul. 10, 2014

(87) PCT Pub. No.: WO2013/104894

PCT Pub. Date: Jul. 18, 2013

(65) Prior Publication Data

US 2015/0052887 A1 Feb. 26, 2015

(30) Foreign Application Priority Data

Jan. 12, 2012 (GB) ..... 1200506.2

(51) Int. Cl.
*F02G 1/045* (2006.01)
*F02G 1/055* (2006.01)
(Continued)

(52) U.S. Cl.
CPC ..... *F02G 1/045* (2013.01); *F02G 1/043* (2013.01); *F02G 1/044* (2013.01); *F02G 1/0435* (2013.01);
(Continued)

(58) Field of Classification Search
CPC ..... F02G 1/045; F02G 1/057; F02G 1/043; F02G 1/055; F02G 1/0435; F02G 1/044; F02G 2244/52
(Continued)

(56) References Cited

U.S. PATENT DOCUMENTS 4,367,625 A * 1/1983 Vitale ..... F02G 1/0435 60/517
4,702,903 A * 10/1987 Keefer ..... B01D 53/047 252/373
(Continued)

FOREIGN PATENT DOCUMENTS

DE 102004018782 11/2005
DE 102004056156 5/2006
WO WO2011/020988 2/2011

OTHER PUBLICATIONS

Kornhauser, et al., The Effects of Heat Transfer on Gas Spring Performance, Transactions of the ASME, vol. 115, Mar. 1993, pp. 70-75.
(Continued)

*Primary Examiner* — Hoang Nguyen
(74) *Attorney, Agent, or Firm* — Bell & Manning, LLC

(57) ABSTRACT

Stirling cycle machines, including engines and coolers or heat pumps are described. In a disclosed arrangement, there is provided a Stirling cycle engine, comprising: an expansion volume structure defining an expansion volume; a compression volume structure defining a compression volume; a gas spring coupling volume structure defining a gas spring coupling volume; a first reciprocating assembly comprising an expansion piston configured to reciprocate within the expansion volume and an expander gas spring piston rigidly connected to the expansion piston and configured to reciprocate within the gas spring coupling volume; and a second reciprocating assembly comprising a compression piston configured to reciprocate within the compression volume and a compressor gas spring piston rigidly con-
(Continued)

nected to the compression piston and configured to reciprocate within the gas spring coupling volume, wherein the gas spring coupling volume structure and the first and second reciprocating assemblies are configured such that power is transferred in use from the expansion piston to the compression piston via the gas spring coupling volume.

38 Claims, 14 Drawing Sheets

(51) Int. Cl.
*F02G 1/043* (2006.01)
*F02G 1/044* (2006.01)
*F02G 1/057* (2006.01)

(52) U.S. Cl.
CPC ..... *F02G 1/055* (2013.01); *F02G 1/057* (2013.01); *F02G 2244/52* (2013.01)

(58) Field of Classification Search
USPC ..... 60/517–526
See application file for complete search history.

(56) References Cited

U.S. PATENT DOCUMENTS

| | | | | |
|---|---|---|---|---|
| 4,717,405 | A * | 1/1988 | Budliger | F02G 1/0435 60/517 |
| 5,146,750 | A | 9/1992 | Moscrip | |
| 8,074,457 | B2 * | 12/2011 | Bin-Nun | F25B 9/00 60/516 |
| 8,820,068 | B2 * | 9/2014 | Dadd | F02G 1/0435 60/517 |
| 2007/0295201 | A1 | 12/2007 | Dadd | |

OTHER PUBLICATIONS

International Search Report and Written Opinion issued in PCT/GB2013/050015, Jun. 24, 2013.
GB Search Report issued in GB1200506.2, May 8, 2012.
Office Action for Chinese Patent Appl. No. 201380005343, issued on Jun. 5, 2015, 24 pp.

* cited by examiner

STIRLING CYCLE MACHINES

This application is a National Stage of International Application No. PCT/GB2013/050015, filed Jan. 7, 2013, which claims the benefit of GB Patent Application No. 1200506.2, filed Jan. 12, 2012, the contents of which are herein incorporated by reference.

The present invention relates to Stirling cycle machines, for example Stirling cycle engines (also referred to as Stirling engines) and Stirling cycle coolers (also referred to as Stirling coolers).

Stirling engines have the potential for generating power efficiently from diverse heat sources that include solar, biomass and radio-nuclides. There has been considerable development of Stirling engines for more than twenty years but the resulting configurations have still not attained significant exploitation.

Large Stirling engines have tended to use "kinematic" configurations that have oil lubricated crank mechanisms. These have demonstrated high efficiency but are relatively expensive to operate, particularly as they generally require frequent servicing—typically at intervals of ~8000 hrs.

Oil free engines have been developed that have demonstrated long maintenance free life e.g. engines made by Sunpower and Infinia. Such configurations use linear technologies that avoid the requirement for crank mechanisms etc. They are capable of high efficiency but so far they have been limited to powers of ~1 kW. This is too small for many potential applications e.g. renewable power using solar and biomass heat sources. There are a number of issues that inhibit scaling to larger sizes. For example, these linear engines do not have any means for controlling the power generated; the beta geometries used require displacer components that become more difficult to resonate; and the annular heater geometry used does not scale well to larger sizes.

Although there are many different configurations of Stirling cycle machine, they all basically consist of a gas filled assembly of two variable volumes Vc, Ve connected by a number of heat exchangers—i.e. a cooler 2, a regenerator 4 and a heater 6, as illustrated in FIG. 1 of the accompanying drawings for example.

The varying volumes Vc, Ve, generated by the piston Pc, Pe and cylinder 5 assemblies, operate at different temperatures with a phase between them that is typically between 60 to 120 deg. The volume with the retarded phase is termed the compression volume Vc and in it work is done on the gas by the piston Pc. The other volume is termed the expansion volume Ve and in this case the gas does work on the piston Pe. The net work of the machine is the difference between the work output of the expansion volume Ve and the work input of the compression volume Vc. For work output to be positive, i.e. for the machine to operate as an engine, the expansion volume temperature Te must be higher than the compression volume temperature Tc. For efficient operation the ratio Te/Tc is made as high as possible. For a practical Stirling engine Te and Tc are typically 1000 K and 300 K respectively.

A key aspect of the configuration of a Stirling engine is the means used to transfer power from the expansion volume Ve to the compression volume Vc so as to maintain engine operation.

In "alpha" type engines the compression and expansion volumes Vc, Ve are quite separate and they are generally mechanically connected via a common crank mechanism 8 as in FIG. 1. An example of this type of engine is the United Stirling V160 engine.

In "beta" and "gamma" engines (the general arrangement of a gamma engine is illustrated in FIG. 2), a displacer 10 is used to cause the expansion work We to act directly on the gas in the compression volume Vc. The "Power" piston 12 now has the combined compression (Wc) and expansion (We) work acting on it, Wc+We. This approach is commonly used as a single piston and cylinder together with a displacer, which can be more easily realized than a two piston arrangement.

Beta engines are similar in operation to gamma engines but are arranged so that the piston and displacer share the same cylinder with the heat exchangers forming an annulus around the cylinder. They have the advantage of a more compact arrangement.

There also exist multi-cylinder engine configurations that use double acting pistons to transfer power. In a Rinia multi-cylinder configuration there are effectively four engines integrated together in a loop so that adjacent engines are 90 degrees out of phase. This arrangement allows each piston to act as an expansion piston for one engine and a compression piston for the engine adjacent to it. The compression power for each engine is therefore supplied directly by the expansion power of an adjacent engine.

All four configurations have been exploited in various Kinematic engines. For high power, high efficiency engines the alpha single cylinder and Rinia multi-cylinder configurations have been the preferred configurations.

Nearly all linear configurations have used a beta configuration although more recently multi-cylinder configurations have being developed. Single cylinder alpha configurations have not generally been used in linear machines because of the lack of a suitable power transfer mechanism. An exception to this is a configuration disclosed in U.S. Pat. No. 5,146,750 (Moscrip). This describes a particular electrical power transfer mechanism.

It is an object of the present invention to provide a configuration for a linear Stirling cycle machine that is geometrically well suited to larger sizes and which can readily incorporate power control mechanisms.

According to an aspect, there is provided a Stirling cycle engine, comprising: an expansion volume structure defining an expansion volume; a compression volume structure defining a compression volume; a gas spring coupling volume structure defining a gas spring coupling volume; a first reciprocating assembly comprising an expansion piston configured to reciprocate within the expansion volume and an expander gas spring piston rigidly connected to the expansion piston and configured to reciprocate within the gas spring coupling volume; and a second reciprocating assembly comprising a compression piston configured to reciprocate within the compression volume and a compressor gas spring piston rigidly connected to the compression piston and configured to reciprocate within the gas spring coupling volume, wherein: the gas spring coupling volume structure and the first and second reciprocating assemblies are configured such that power is transferred in use from the expansion piston to the compression piston via the gas spring coupling volume.

This arrangement incorporates a novel arrangement for transferring power from the expansion volume to the compression volume. The expansion and compression volumes may be part of the same engine unit or different engine units. The arrangement is especially suited for linear, alpha configuration machines. The arrangement can be scaled up easily without losing efficiency and is therefore geometrically well suited to larger sizes. The arrangement can readily incorporate power control mechanisms. In an embodiment, the power control mechanisms comprise one or more transducers that interact with the first and/or second reciprocating assemblies.

In an embodiment, a controller is provided that controls one or more of the following: the power output of the engine, the amount of power transferred from the first reciprocating assembly to the second reciprocating assembly, the phase difference between the movements within the first and second reciprocating assemblies, the frequency of the movement of the first and second reciprocating assemblies. In an embodiment, the controller controls a transducer in the first and/or second reciprocating assemblies.

In an embodiment, pairs of linear suspension springs are provided for guiding movement of components within one or both of the first and second reciprocating assemblies. The pairs of linear suspension springs provide the basis for highly accurate linear guiding of components. In an embodiment, the expansion piston, expander gas spring piston, compression piston and/or compressor gas spring piston can be guided to move within corresponding close-fitting bores without the need for lubricant and/or direct contact between the piston(s) and bore(s). Lubricant free, long-life operation is therefore facilitated.

In an embodiment, balanced engine operation is achieved by providing two sets of said first reciprocating assembly, said second reciprocating assembly, and said gas spring coupling volume structure, each set being arranged so that, in use, the position of the center of mass of the engine remains constant.

In an embodiment, balanced engine operation is achieved by providing a third reciprocating assembly comprising a further compression piston configured to reciprocate within a further compression volume and a further compressor gas spring piston rigidly connected to the further compression piston and configured to reciprocate within the gas spring coupling volume. In an embodiment, the second and third reciprocating assemblies are positioned on opposite sides of the first reciprocating assemblies and configured such that a resultant inertial force arising from movement within the second and third reciprocating assemblies acts along the axis of reciprocating movement within the first reciprocating assembly. In an embodiment, a balancer mass is provided that is configured to act along the axis of reciprocating movement within the first reciprocating assembly.

According to an aspect, there is provided a Stirling cycle cooler, comprising: an expansion volume structure defining an expansion volume; a compression volume structure defining a compression volume; a gas spring coupling volume structure defining a gas spring coupling volume; a first reciprocating assembly comprising an expansion piston configured to reciprocate within the expansion volume and an expander gas spring piston rigidly connected to the expansion piston and configured to reciprocate within the gas spring coupling volume; and a second reciprocating assembly comprising a compression piston configured to reciprocate within the compression volume and a compressor gas spring piston rigidly connected to the compression piston and configured to reciprocate within the gas spring coupling volume, wherein: the gas spring coupling volume structure and the first and second reciprocating assemblies are configured such that power is transferred in use from the expansion piston to the compression piston via the gas spring coupling volume.

Embodiments of the invention will now be described, by way of example only, with reference to the accompanying drawings in which corresponding reference symbols indicate corresponding parts, and in which.

Figure 1:
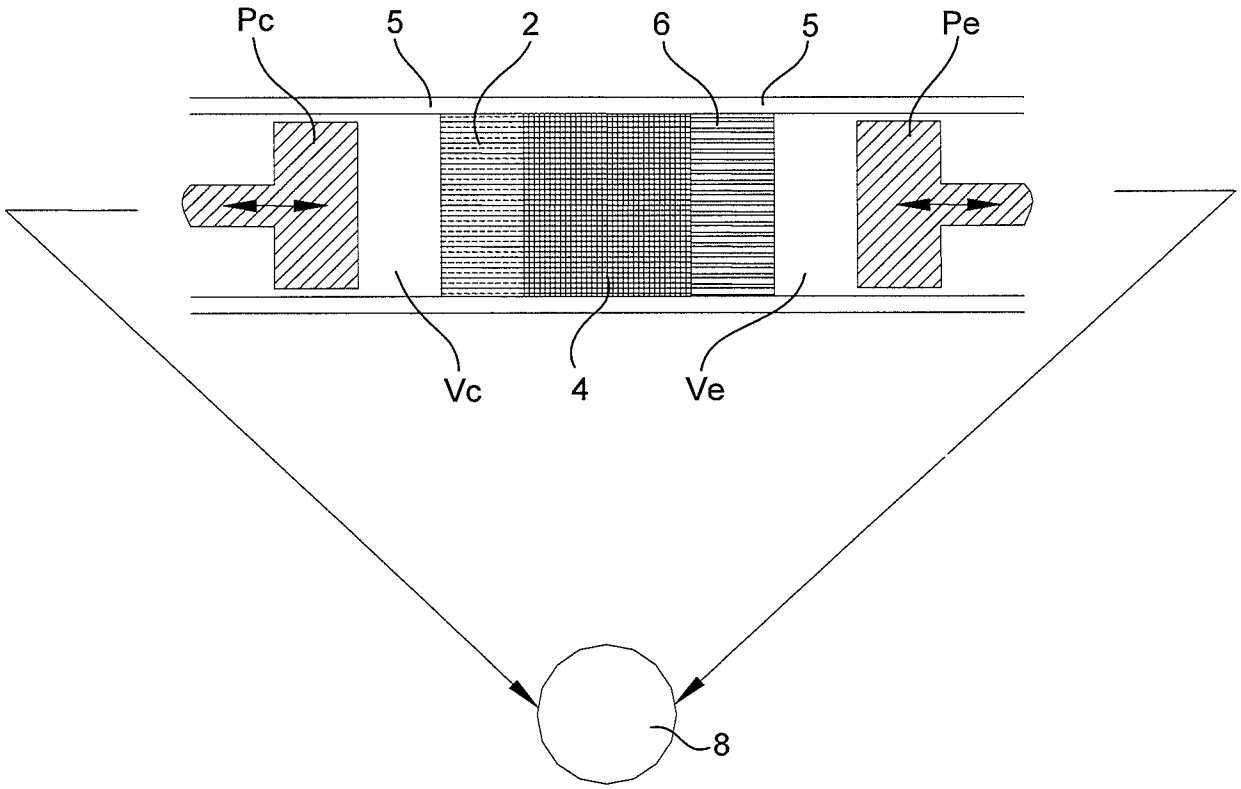
FIG. 1 depicts a prior art, alpha type Stirling cycle engine comprising a crank mechanism.
Figure 2:
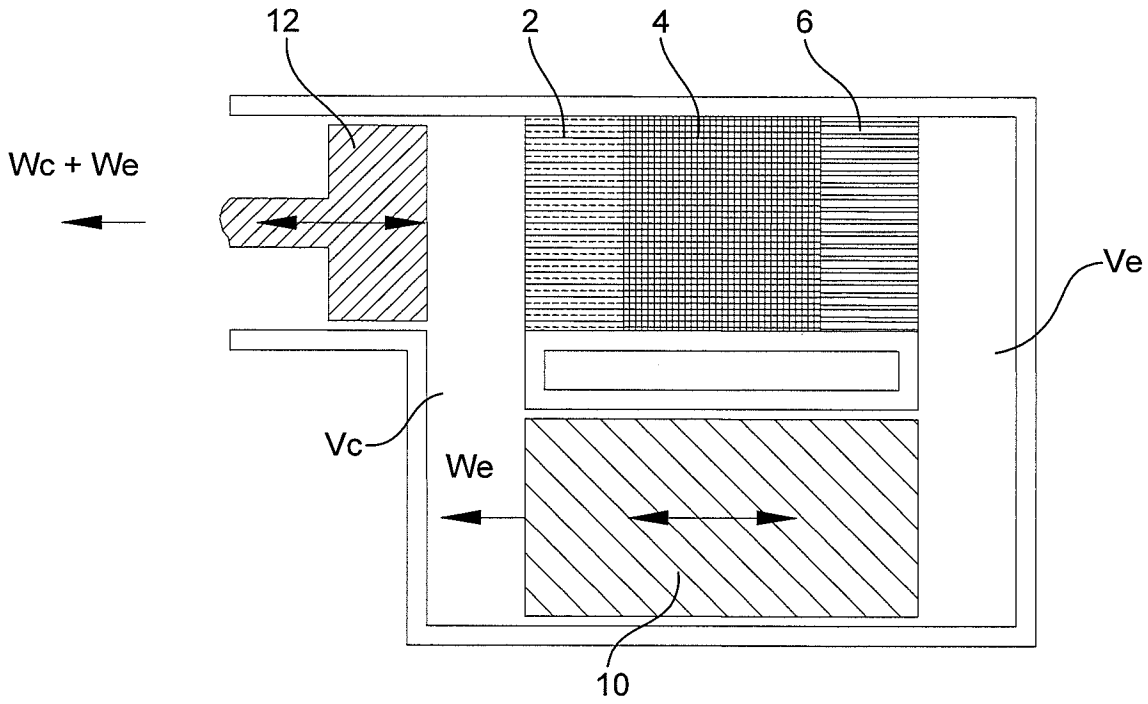
FIG. 2 depicts a prior art, gamma type Stirling cycle engine.

As mentioned above, typical prior art alpha type Stirling cycle engines (as illustrated in FIG. 1) require a mechanical connection to transfer power from the expansion volume Ve to the compression volume Vc. However, such machines are relatively expensive to operate, particularly as they require frequent servicing.

Figure 3:
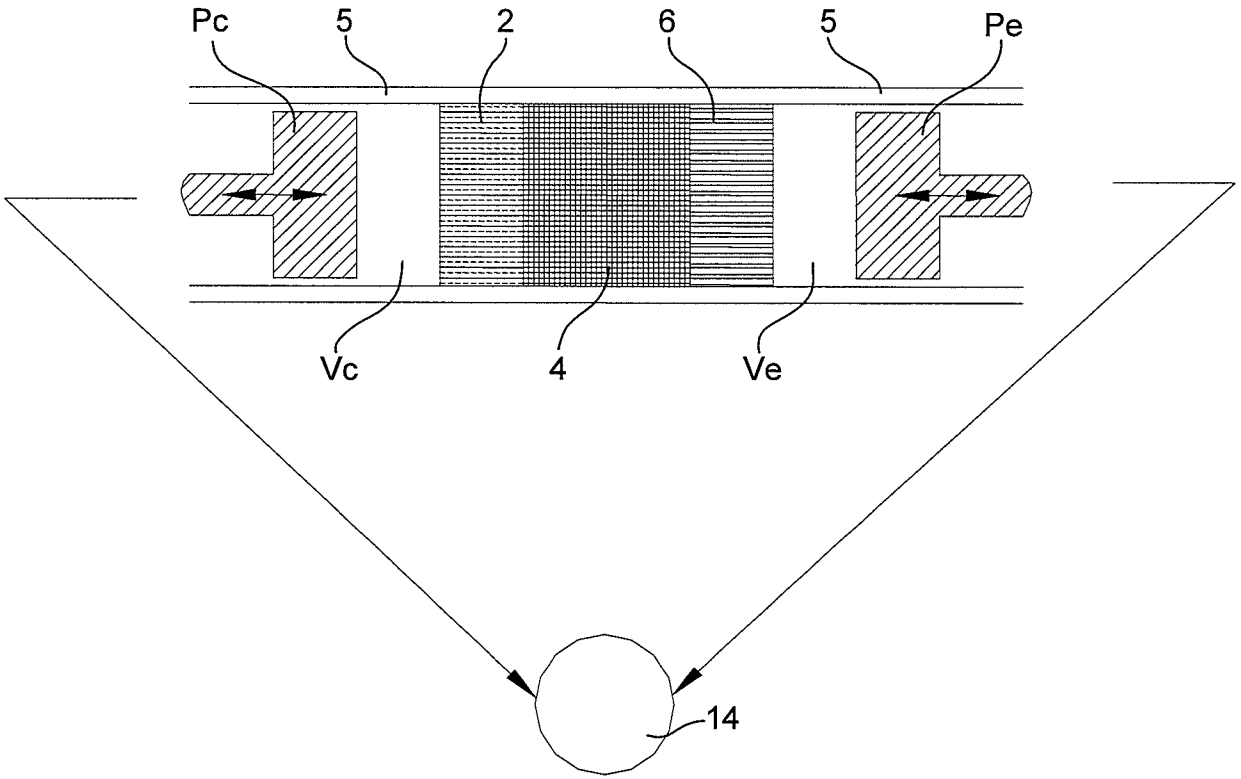
FIG. 3 depicts an alpha type Stirling cycle engine in which a gas spring coupling allows for power transfer from the expansion piston to the compression piston.

FIG. 3 illustrates an alternative approach in which a gas spring coupling 14 is provided for transferring power from the expansion volume Ve to the compression volume Vc. The gas spring coupling requires fewer moving parts and/or less or no lubrication. Embodiments of the type shown in FIG. 3 can therefore be operated more cheaply and/or with longer service intervals in comparison with arrangements of the type illustrated in FIG. 1.

Figure 4:
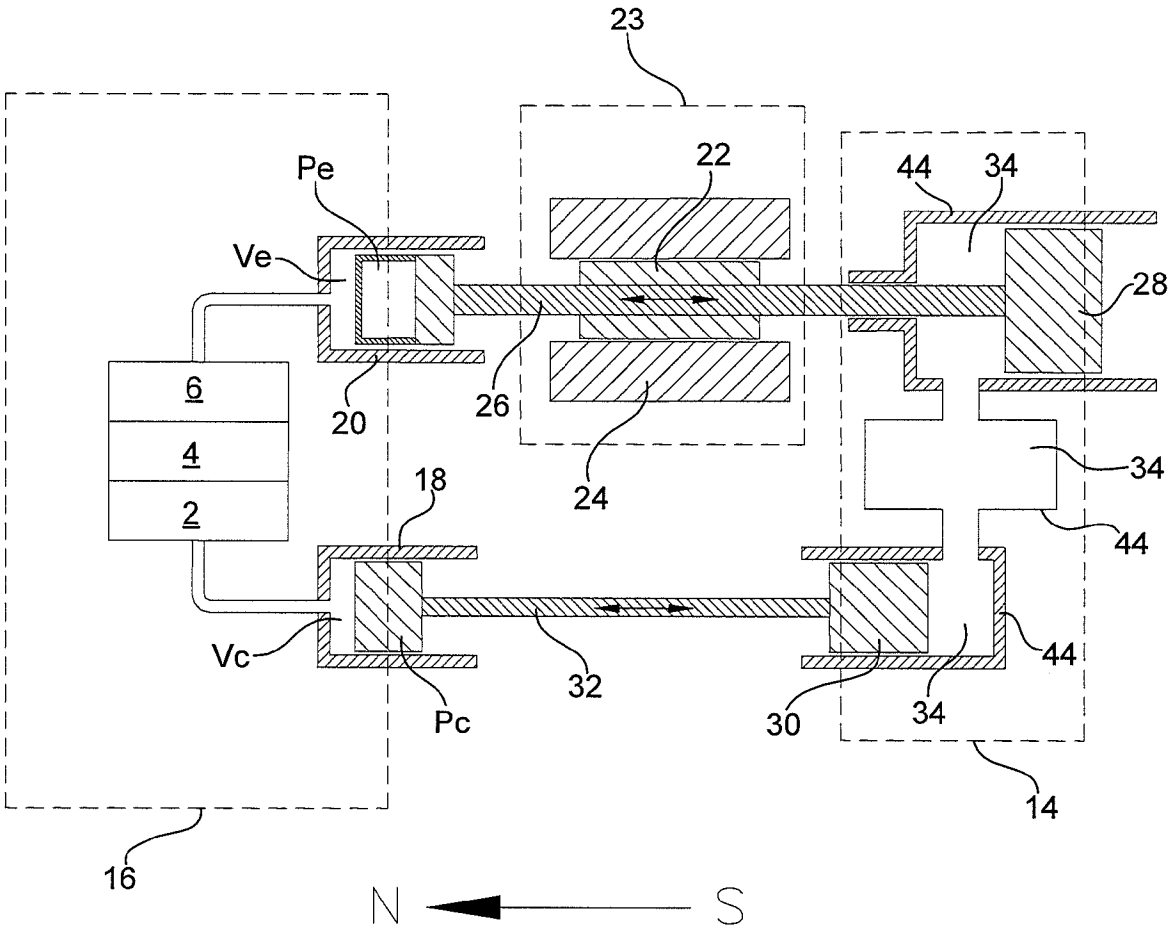
FIG. 4 depicts an arrangement of the type shown in FIG. 3 in which a linear generator is provided between the expansion piston and the expander gas spring piston.

An embodiment of the type illustrated in FIG. 3 is depicted in further detail in FIG. 4. On the left hand side is an alpha configuration Stirling engine 16 comprising compression volume Vc defined by a compression volume structure 18, expansion volume Ve defined by an expansion volume structure 20, cooler 2, regenerator 4 and heater 6. The cooler 2, regenerator 4 and heater 6 may be referred to as a cooler-regenerator-heater system. The cooler-regenerator-heater system is configured to exchange heat with gas flowing between the compression volume and the expansion volume. In an embodiment, the heater 6 operates at a higher temperature than the cooler 2. However this is not essential. In alternative embodiments, for example embodiments in which the system is configured to act as a cooler rather than an engine (see FIG. 12 and the corresponding discussion below for example), a component corresponding to the "heater" is operated at a lower temperature than a component corresponding to the "cooler".

In an embodiment, the expansion piston Pe engages within the expansion volume structure 20 and is configured to be movable in a reciprocating manner therein. The expansion piston Pe is part of a first reciprocating assembly. In the embodiment shown, the expansion piston Pe is mechanically (e.g. rigidly) connected to the armature 22 of a linear generator 23 via an expansion coupling member 26. In such an embodiment, the expansion coupling member 26 is also part of the first reciprocating assembly. In an embodiment, the expansion coupling member 26 is provided in the form of a shaft or rod. In an embodiment, movement of the armature 22 relative to a stator 24 of the linear generator 23 generates electricity. In an embodiment, the piston Pe is also coupled to a gas spring coupling 14, optionally via the expansion coupling member 26. In an embodiment, the piston Pe is coupled (e.g. rigidly) to an expander gas spring piston 28, which in this embodiment is part of the first reciprocating assembly and is configured to reciprocate within a gas spring coupling volume 34. The gas spring coupling volume 34 is defined by a gas spring coupling volume structure 44. The expander gas spring piston 28 is part of the gas spring coupling 14.

In an embodiment, the compression piston Pc engages within the compression volume structure 18 and is configured to be movable in a reciprocating manner therein. The compression piston Pc is part of a second reciprocating assembly. In the embodiment shown, the compression piston Pc is mechanically (e.g. rigidly) connected to a compressor gas spring piston 30, which in this embodiment is part of the second reciprocating assembly and is configured to reciprocate within the gas spring coupling volume 34, optionally via a compression coupling member 32 (which in this embodiment is also part of the second reciprocating assembly). In an embodiment, the compression coupling member 32 is provided in the form of a shaft or rod. The compressor gas spring piston 30 is also part of the gas spring coupling 14.

In the embodiment shown in FIG. 4, the second reciprocating assembly does not include an electrical transducer. In other embodiments, as will be described below, a transducer is provided. In an embodiment, the transducer is a motor.

In describing the operation of the engine it is helpful to refer to different faces of a piston. A north/south direction is shown in FIG. 4 which will be used to give a consistent reference direction. In an embodiment, the north direction corresponds to the direction of inward motion of the compression piston Pc into the compression volume Vc and/or the direction of inward motion of the expansion piston Pe into the expansion volume Ve. In an embodiment, the south direction corresponds to the direction of outward motion of the compression piston Pc out of the compression volume Vc and/or the direction of outward motion of the expansion piston Pe out of the expansion volume Ve.

The north faces of the compression and expansion pistons Pc, Pe compress and expand the gas in the Stirling engine components (the compression and expansion volumes Vc, Ve). As described above, the expansion displacement is typically 60 to 120 degrees in advance of the compression displacement. There is a power input from the compression piston Pc into the gas and a power output from the gas into the expansion piston Pe. For an engine the expansion power is larger than the compression power so there is net power generation. The gas spring coupling 14, which is a coupling based on the principle of a gas spring, provides a power transfer between the first reciprocating assembly (which may also be referred to as the expansion assembly) and the second reciprocating assembly (which may also be referred to as the compression assembly). In this way the compression power (required by the compression piston Pc) is provided by the expansion piston Pe and the linear generator 23 is used to transform the remaining power into an electrical power output.

Figure 5:
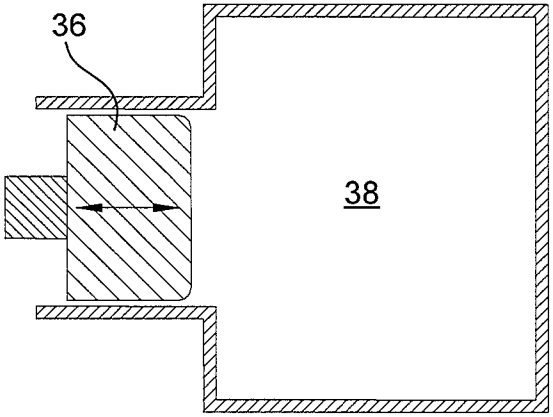
FIG. 5 depicts a gas spring.

The operation of a gas spring will now be described in more detail. FIG. 5 shows a simple gas spring comprising a single piston cylinder assembly connected to an enclosed volume 38. Displacement of the piston 36 changes the size of the enclosed volume 38 and generates an accompanying pressure variation that tends to provide a restoring force. The net effect is for the gas to act as a spring, storing energy during compression and releasing it during expansion. If the piston 36 is part of a reciprocating assembly then the gas spring force will be in phase with the displacement and ideally it will not consume any power.

Figure 6:
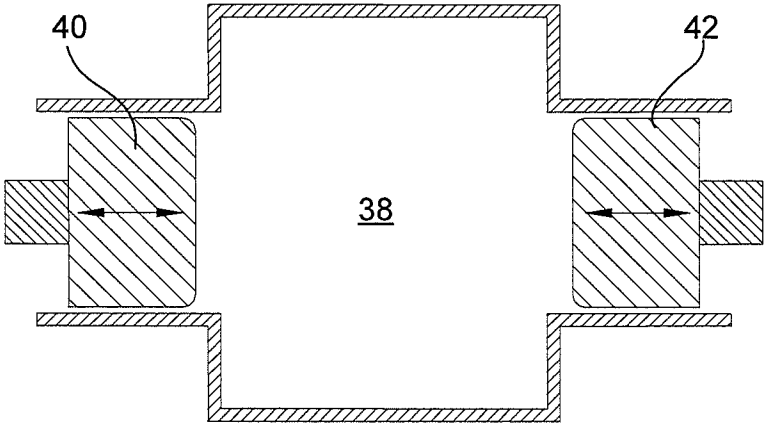
FIG. 6 depicts a gas spring coupling.

FIG. 6 shows a gas spring that has two reciprocating piston/cylinder assemblies connected to a single enclosed volume 38. If the displacements of the pistons 40,42 with respect to each other are in phase or anti-phase (i.e. 180 deg out of phase) then the gas spring force will again be in phase or anti-phase with both displacements and neither piston 40,42 will consume any power.

For a phase difference between the displacements other than 0 and 180 degrees it is found that although there is still no overall power consumption, there is a net transfer of power from one piston to the other. This can be seen by considering two pistons with equal displacements. When the pistons are in phase the gas pressure variations are in anti-phase. If one piston is advanced 60 degrees with respect to the other then consideration of the point of minimum volume determines that the pressure variation will advance 30 degrees with respect to one piston and be retarded by 30 degrees with respect to the other piston. There is therefore an equal and opposite work done by each piston. Overall the piston that is advanced gains power from the other piston.

More generally a gas spring coupling can have two or more pistons (i.e. displacement mechanisms) that are undergoing some cyclic variation—e.g. as determined by sinusoidal motion. The displacements will combine to produce a pressure variation. The pistons whose minimum volume is in advance of the peak pressure will absorb energy. The pistons whose minimum volume is retarded with respect to the peak pressure will lose energy. In this way power is transferred between pistons. The phase relationship determines the polarity of the power transfer. The magnitude is determined by swept volume, i.e. piston diameter and stroke, and phase angle.

Returning to the embodiment shown in FIG. 4, it is seen that the gas spring coupling 14 can transmit power from the expansion piston Pe to the compression piston Pc providing the displacements of the corresponding expander gas spring piston 28 and compressor gas spring piston 30 with respect to the gas spring coupling volume 34 are appropriate—i.e. the displacement for the compressor gas spring piston 30 needs to be in advance of the expander gas spring piston 28.

For the Stirling engine to operate it has already been stated that the expansion piston Pe must be in advance of the compression piston Pc and the phase difference is typically in the range 60 to 120 degrees. If the south faces of the two gas spring pistons 28, 30 are considered for the gas spring coupling then it is found that the phase difference is incorrect—the gas spring coupling would transfer power from the compression piston Pc to the expansion piston Pe. A way round this is to introduce a 180 degree phase shift by combining a north face for one gas spring piston 28, 30 with a south face for the other 30,28. For example, in FIG. 4 the north face of expander gas spring piston 28 and the south face of the compressor gas spring piston 30 are the surfaces that face into the gas spring coupling volume 34. If the expansion piston Pe is 120 degrees in advance of the compression piston Pc then the 180 degree phase shift from using opposite faces (i.e. north for one gas spring piston 28,30 and south for the other gas spring piston 30, 28) results in the displacement of the compressor gas spring piston 30 being 60 degrees in advance of the displacement of the expander gas spring piston 28.

FIG. 4 shows one example embodiment. However, in other embodiments different configurations are used for transmitting power from the expansion piston Pe to the compression piston Pc. For example the piston polarities for the gas spring coupling 14 could be reversed so that the south face of the expander gas spring piston 28 and the north face of compressor gas spring piston 30 face into the gas spring coupling volume 34. It is also possible to use the south side of either the compression piston Pc or the expansion piston Pe as part of the gas spring coupling 14. An example embodiment of this type is shown in FIG. 7.

Figure 7:
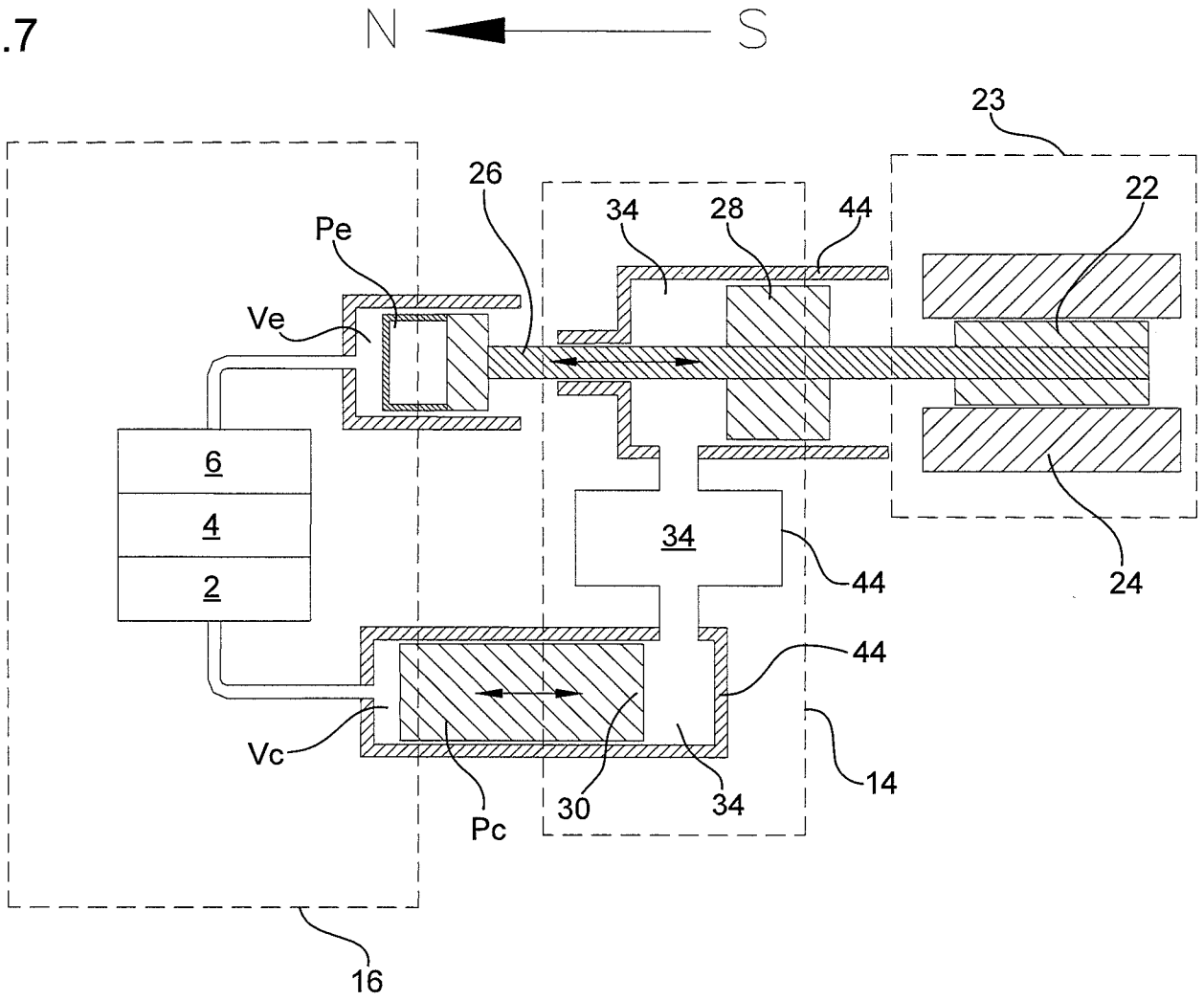
FIG. 7 depicts an arrangement of the type shown in FIG. 4 except that the expander gas spring piston is provided between the linear generator and the expansion piston.

In the embodiment shown in FIG. 7, the linear generator 23 is positioned at the end of the first reciprocating assembly, with the expander gas spring piston 28 and part of the gas spring coupling volume structure 44 positioned in between the linear generator 23 and the expansion piston Pe. In an embodiment, an expansion coupling member 26 is provided, optionally in the form of a shaft or rod, that extends beyond the gas spring coupling volume structure 44. In an embodiment, the expansion coupling member 26 is rigidly connected to an armature 22 of the linear generator 23.

In the description given above, possible losses in the gas spring coupling 14 are not discussed. In practice these losses can be significant and for efficient operation of an engine it is desirable that they be kept to a minimum. There are two loss mechanisms to be considered:

Piston seal loss

Gas spring loss due to heat transfer

The piston seal loss is due to gas leakage past one or more of the pistons 28,30 in the gas spring coupling 14, driven by the pressure variations. This is a common engineering problem and can be controlled by a variety of means; small piston cylinder clearance, contacting seals (e.g. pistons rings), lubricants etc.

The gas spring loss due to heat transfer is more complex and has only been analyzed in detail for a few specific geometries; nonetheless the general mechanisms are well understood. The main requirement for the gas spring is that the compression and expansion processes should be reversible. In principle there is a choice; either the processes are isothermal—they are reversible because the temperature variations are very small, or the processes are adiabatic—they are reversible because there is no heat exchange. In between these limits the processes exchange heat with significant temperature drops and the inherent irreversibilities lead to significant losses. The factor deciding the scale of the loss is the Peclet number. This is a dimensionless parameter that gauges where a process lies between the isothermal and adiabatic extremes. A high Peclet number denotes an adiabatic process; a low one denotes an isothermal process.

It is found that for machines operating at 50 Hz with dimensions consistent with power outputs of 1 kW, reversibility is more easily attained by pursuing adiabatic processes. In practice this demands that heat transfer should be minimized as far as possible by minimizing the surface area and also keeping flow velocities down.

Accurate values for adiabatic gas springs are not readily calculated for arbitrary geometries. However losses for cylindrical geometries have been subject to both theoretical and experimental investigations that resulted in a fairly reliable loss correlation (see Kornhauser A. A, Smith J. L, "The Effects of heat Transfer on Gas Spring Performance", Transactions of the ASME, Vol 115, March 1993 pages 70 to 75). Estimates of losses using this correlation suggest that very high efficiency can be obtained using suitable gas spring geometries.

It is noted there are changes in volume wherever there are displacements and that every piston has two faces. There may therefore be unintended pressure variations in other parts of the engine, e.g. around the armature 22. The magnitude of these variations can be reduced by ensuring there is sufficient volume. Nonetheless such volumes may have extended heat transfer surfaces and so may introduce significant losses. This aspect is considered again below in the context of a more detailed example.

The embodiments described above have focused on the use of the gas spring coupling 14 to provide efficient power transfer (i.e. feedback) from the expansion piston Pe (and/or first reciprocated assembly) to the compression piston Pc (and/or second reciprocating assembly). In this basic form there is no provision for controlling power or modifying operating characteristics. The feedback is mainly fixed by the geometry and the dynamics and these are not readily changed by external intervention.

In an embodiment, features for implementing synchronization, controlling the power output of the engine, the amount of power transferred from the first reciprocating assembly to the second reciprocating assembly, the amplitude (position/stroke) of the movement within the first reciprocating assembly and/or the second reciprocating assembly, the phase difference between the movements within the first and second reciprocating assemblies and/or frequency of the movement of the first and second reciprocating assemblies are provided. In an embodiment, a controller is provided. In an embodiment, the controller controls operation of a transducer in the first and/or second reciprocating assemblies. In an embodiment a measurement device is provided for measuring one or more operating characteristics of the engine. In an embodiment, the measurement device measures one or more of the following: the power output of the engine, the amount of power transferred from the first reciprocating assembly to the second reciprocating assembly, the amplitude (position/stroke) of the movement within the first reciprocating assembly and/or the second reciprocating assembly, the phase difference between the movements within the first and second reciprocating assemblies and/or the frequency of the movement of the first and second reciprocating assemblies. In an embodiment, the measurement device is configured to provide input to the controller. Such features are particularly useful if multiple engine units are to be integrated together to give a common output.

Figure 8:
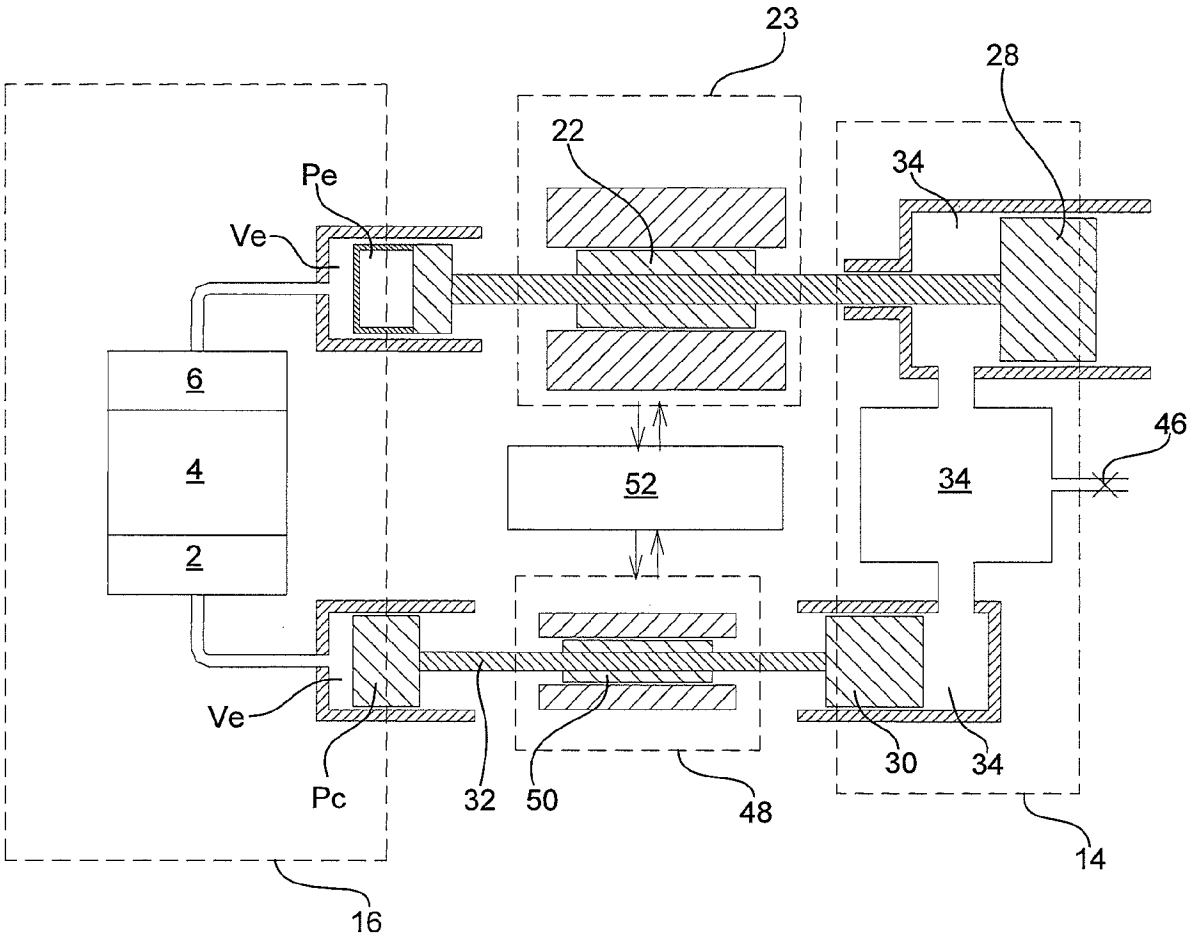
FIG. 8 depicts an arrangement of the type shown in FIG. 4 with an additional transducer provided between the compression piston and the compressor gas spring piston, a controller and a venting valve in the gas spring coupling volume.

FIG. 8 illustrates a number of approaches that can be used either individually or together to extend the versatility of the basic engine configuration. These will be described briefly below.

In an embodiment, a valve 46 is provided for controllably venting the gas spring coupling volume 34. The valve 46 provides a simple but effective way of exercising power control. With the valve 46 shut the power transfer will be at its most efficient and the engine will run at its maximum design power. If the valve 46 is opened sufficiently then this will ruin the feedback and the engine will stop. In between there is the possibility of throttling the flow so that some power control is possible. The throttling process will dissipate energy so this will not necessarily be the most efficient method. Various valve geometries can be used as well as different mechanisms for their operation.

In an embodiment, an electromagnetic transducer 48 is integrated into the compressor assembly (the second reciprocating assembly). An example of such a configuration is shown in FIG. 8. The electromagnetic transducer 48 allows the balance of forces acting on the compression coupling member 32 (via the armature 50) to be modified so that power output, operating frequency and phase of the engine can be controlled. There are two ways in which the transducer 48 can be used, either together or separately: 1) with an external power input/output; and/or 2) with an additional electrical power transfer between generator 23 and transducer 48 (i.e. as motor) via an electrical phase/amplitude changing circuit.

The gas spring coupling power transfer mechanism can be designed to provide either too much or too little power. In both cases, embodiments may be provided in which the electromagnetic transducer 48 is configured to modify engine operation by adding or subtracting power.

In an example embodiment, the transducer 48 has an external power input or is connected to a load so it provides damping that will reduce the power in the compressor assembly (the second reciprocating assembly).

In an embodiment, a direct electrical feedback circuit 52 is provided. The direct electrical feedback circuit 52 operates in a manner that is analogous to the gas spring coupling 14. In an embodiment, different reactive components are used and/or the polarity of the transducer 48 with respect to the generator 23 is changed, to arrange for the electrical feedback to reinforce the mechanical power transfer or to oppose it, as desired.

In an embodiment, the engine is configured so that most of the power transfer is provided by the gas spring coupling 14. An electrical feedback is then used to fine tune the engine balance so that the feedback to the compressor assembly (the second reciprocating assembly) is slightly insufficient. A small external input is then used to control the engine power and/or determine its operating frequency and/or phase so that it can be readily integrated with other power sources. In an embodiment, the valve 46 is configured to act as an emergency "on/off valve" in the event of a loss of generator load.

In a Stirling engine that uses linear drive mechanisms, the position of the pistons is not geometrically determined by crank mechanisms. Instead it is determined by the dynamics of the two moving assemblies (the first and second reciprocating assemblies). In practice this dictates that mechanical resonance for both the first and second assemblies need to be equal or close to the operating frequency depending on the engine phase angle required. The mechanical resonances are determined by the moving masses and the spring stiffnesses. In an embodiment, it is desirable to minimize the sizes of the moving masses, subject to providing the necessary strength and rigidity. In such an embodiment, adjustment of the mechanical resonances is carried out predominantly by adjusting the spring stiffnesses. In an embodiment, the mass is also adjusted.

There are four possible sources of spring stiffness:

Mechanical springs

Effective spring stiffness generated by expansion or compression pistons Pe, Pc

Spring stiffness generated by gas spring coupling 14

Spring stiffness generated by additional gas springs.

The spring stiffness contributed by mechanical springs is significant for small engines e.g. <100 W power, but for engines in the 1 kW+ range it is small enough to be neglected.

In an alpha configuration engine it is found that the compression piston Pc has significant spring stiffness. The expansion piston Pe however generally has an effective value ~0—it is quite possible for the spring stiffness to be slightly negative.

Significant spring stiffness can be generated by the gas spring coupling 14 for both compressor and expander assemblies (first and second reciprocating assemblies), depending on the piston diameters and phases etc.

Additional gas springs can be added to both compressor and expander assemblies (first and second reciprocating assemblies) to further increase spring stiffness.

There is therefore considerable scope for adjusting the dynamics to that required. The main proviso that needs consideration is that as the engine size is increased the stroke is also increased to retain workable dimensions for the linear motors etc. For a given displacement and pressure excursion the spring stiffness reduces rapidly with increasing stroke. It is therefore inevitable that as size increases the maximum operating frequency is reduced. It is found that for a ~10 kW engine 50 Hz operation is possible but above this size the frequency may need to be reduced.

The description given above has referred generally to linear technologies that do not require lubrication. A specific technology that is well suited to this engine configuration is one which has been developed for coolers used in space. This uses sets of flexures to provide accurate linear suspension systems—equivalent to a linear bearings. Each flexure may be referred to as a linear suspension spring. In an embodiment, pairs of linear suspension springs are provided that guide reciprocating movement of a piston within a bore. Contacting seals are not used. Instead, a small clearance is maintained between the piston and the bore (such that the piston and corresponding bore are "close-fitting") that maintains a leakage loss at an acceptable level. In an embodiment, the clearance is about 10 microns.

In other embodiments, linear gas bearings are used, as an alternative oil free mechanism, to guide movement of one or more pistons of the Stirling cycle engine.

Figure 9:
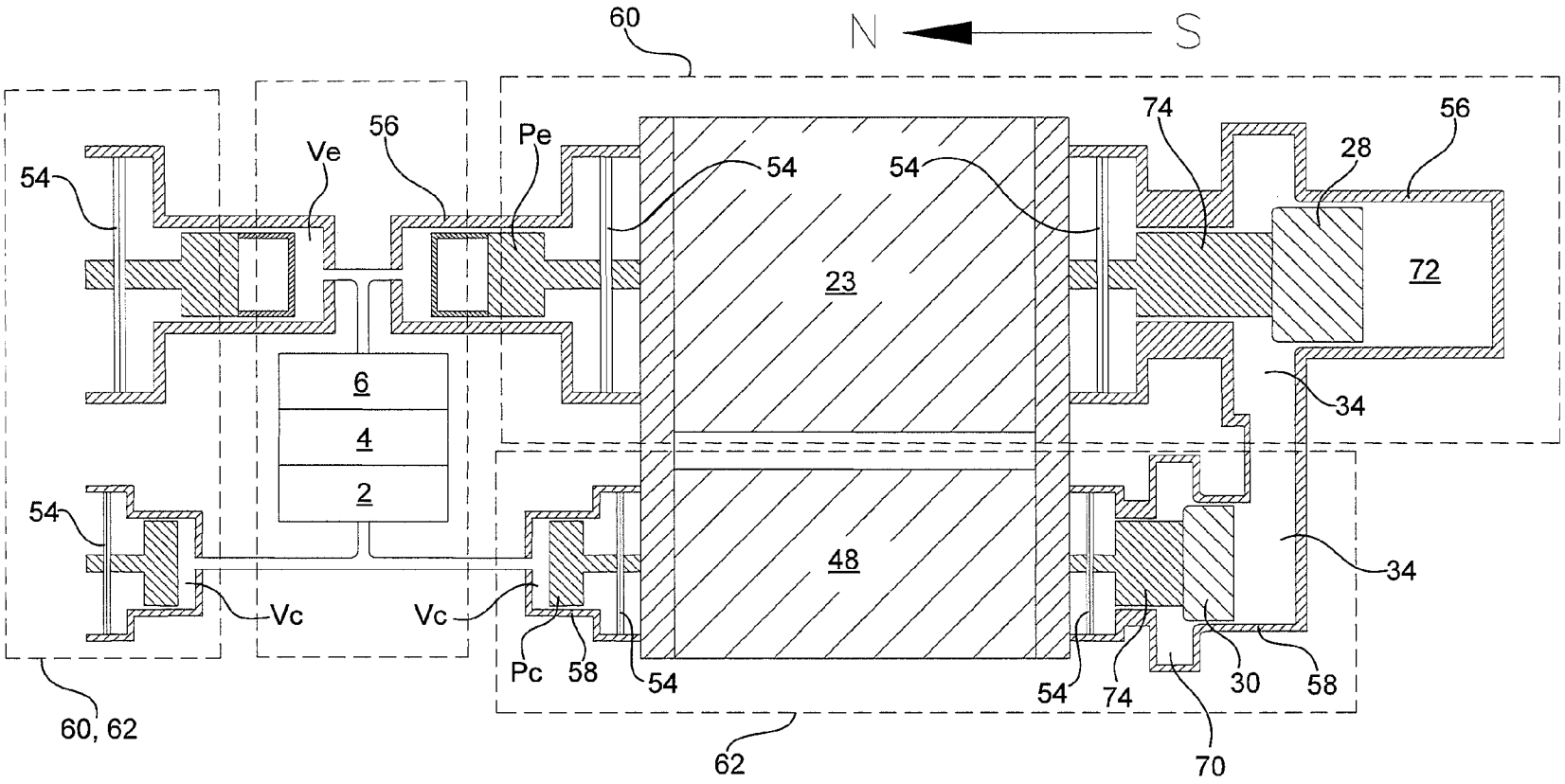
FIG. 9 depicts one half of an engine system comprising a balanced pair of first reciprocating assembly, second reciprocating assembly and gas spring coupling of the type illustrated in FIG. 4, with linear suspension springs providing for lubricant free operation.

FIG. 9 illustrates an example embodiment including pistons that are guided to move within corresponding closely-fitting bores using pairs of linear suspension springs.

In the example shown, linear suspension springs 54 are provided on each side of the generator 23 to guide linear, reciprocating movement of the expansion piston Pe and the expander gas spring piston 28 within corresponding respective bores 56. In the example shown, linear suspension springs 54 are also provided on each side of the motor 48 to guide linear, reciprocating movement of the compression piston Pc and the compressor gas spring piston 30 within corresponding respective bores 58.

The embodiments described in detail above (with reference to figures prior to FIG. 9) have a single compressor assembly (first reciprocating assembly) and a single expander assembly (second reciprocating assembly) which reciprocate with a phase angle of ~60 to 120 degrees. These arrangements are unbalanced and the vibration they would generate would not be acceptable for the majority of applications.

There are a number of ways of producing a balanced engine. One method is to use two separate engines and arrange them so that the two sets of piston assemblies are horizontally opposed either with heat exchangers on the inside or outside (i.e. NSSN or SNNS). Each piston is then equally balanced by a mirrored companion.

Another method that will give even better balance is to have a single engine but adopt balanced piston pairs for both compression and expansion volumes. With matching pistons and an engine pressure variation that is common to both sets, symmetry should ensure that very good balance is achieved. An example of such an arrangement is illustrated in FIG. 9 where all the heat exchangers are common to both halves.

In the example shown in FIG. 9, two pairs of first and second reciprocating assemblies, 60 and 62 respectively, are provided. One reciprocating assembly of each of the two reciprocating assemblies is shown in full while only a portion of the other assemblies (the expansion and compression pistons and adjacent linear suspension springs 54) are shown (at the left hand side of the figure). The expansion volumes Ve of each of the two first reciprocating assemblies 60 are connected to a common heater 6 of a cooler-regenerator-heater system. The compression volumes Vc of each of the two second reciprocating assemblies 62 are connected to a common cooler 2 of the same cooler-regenerator-heater assembly. In an embodiment, the movements of the two first reciprocating assemblies 60 are balanced so that the centre of mass of the two first reciprocated assemblies 60 remains stationary. In an embodiment, the movements of the two second reciprocating assemblies 62 are balanced so that the centre of mass of the two second reciprocated assemblies 62 remains stationary.

Figure 10:
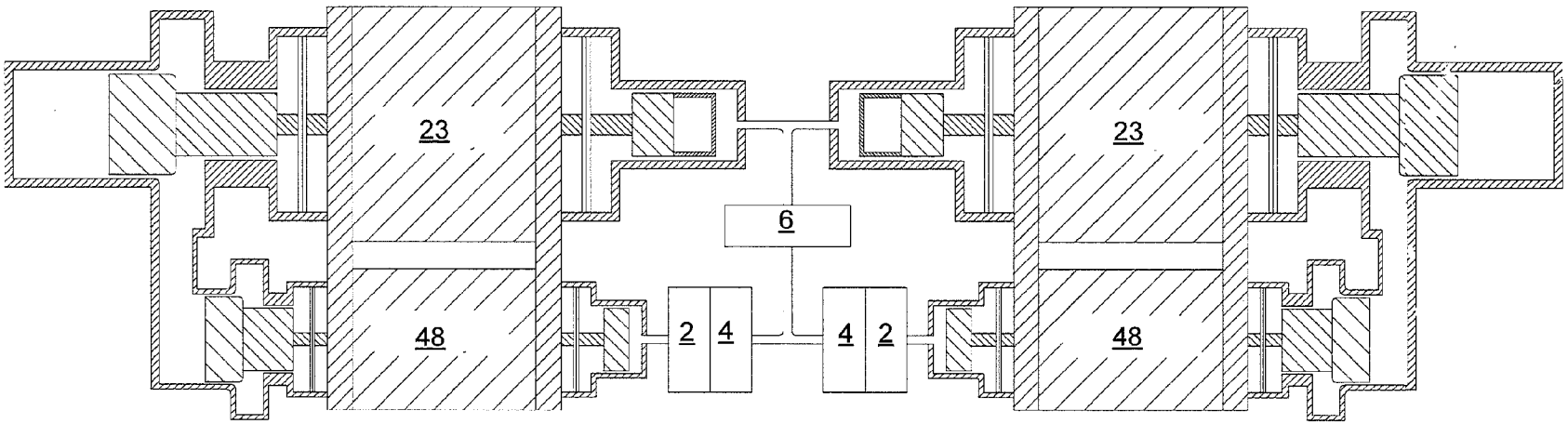
FIG. 10 depicts an arrangement of the type shown in FIG. 9 in which the heater-regenerator-cooler system comprises a common heater, shared between both pairs, and two separate regenerator-coolers.

In an alternative embodiment, the cooler-regenerator-heater assembly is arranged so that each half has its own cooler 2 and regenerator 4 but share a common heater 6, as is shown in FIG. 10.

Figure 11:
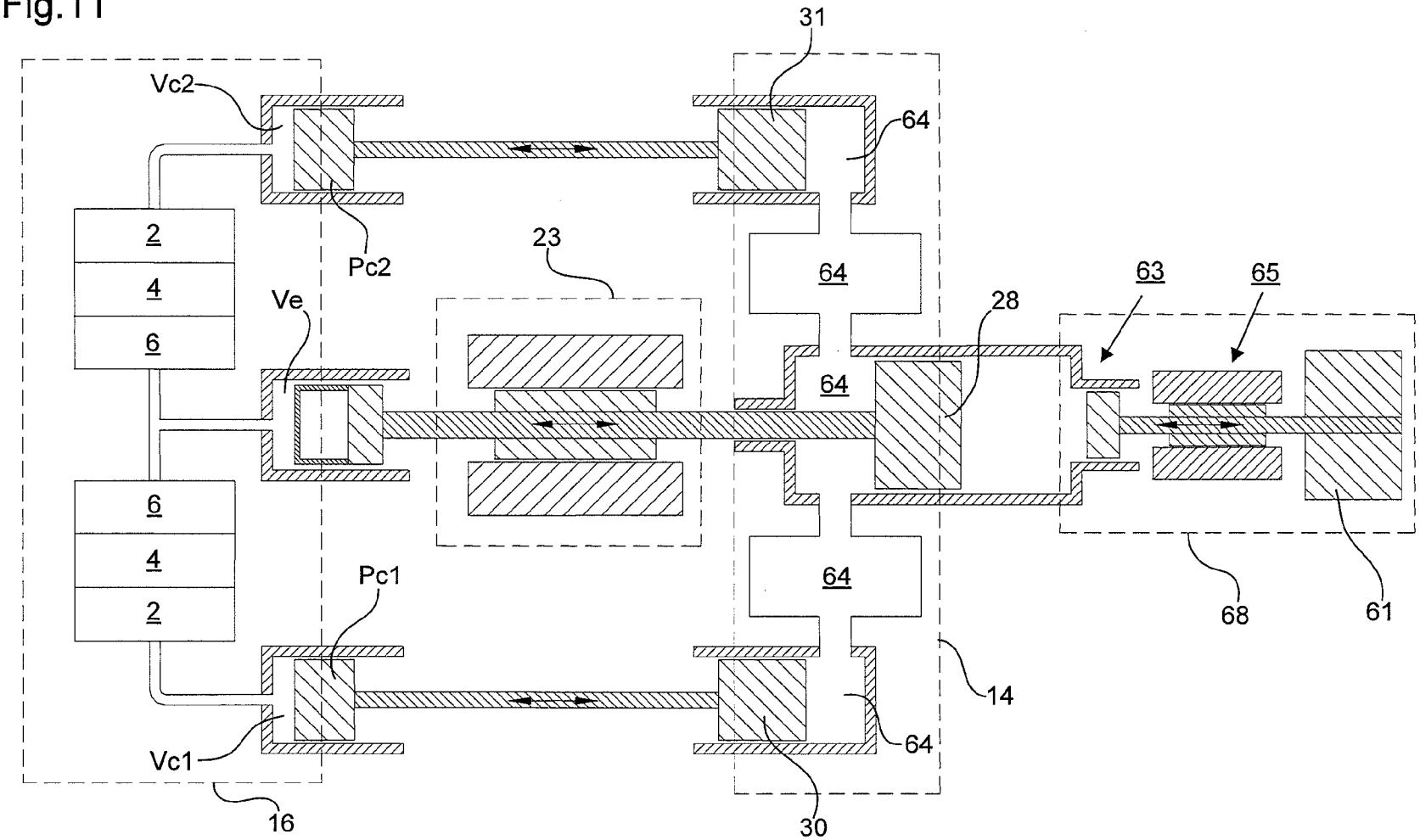
FIG. 11 depicts an engine having one reciprocating assembly comprising an expansion piston and expander gas spring piston and two reciprocating assemblies having a compression piston and a compressor gas spring piston, one on either side, and a balancer mass configured to move along the axis of the central reciprocating assembly.

FIG. 11 illustrates an embodiment in which an alternative approach for balancing a single compressor/expander assembly is employed. In this embodiment, two compressor assemblies are provided (which may be referred to as second and third reciprocating assemblies), coupled via a gas spring coupling 14 to a single expansion assembly (first reciprocated assembly). The second reciprocating assembly comprises a compression piston Pc1 moving within a compression volume Vc1 and a compressor gas spring piston 30 moving within the gas spring coupling volume 64. The third reciprocating assembly comprises a further compression piston Pc2 moving within a further compression volume Vc2, and a further compressor gas spring piston 31 moving within the gas spring coupling volume 64. In the embodiment shown, the two compressor assemblies are arranged symmetrically about the axis of the single expander assembly, one on each side of the expander assembly. With this arrangement all inertial forces arising due to linear movement with the two expansion assemblies will act along the axis of the single expansion assembly (i.e the axis along which reciprocating movement within the first reciprocating assembly takes place). Inertial forces arising due to linear movement within the single expansion assembly will also act along the axis of the single expansion assembly. In such an arrangement a single balancer 68, configured to provide movement of a balance mass 61 parallel or anti-parallel to the axis of the single expansion assembly can completely balance all three assemblies.

In the embodiment shown in FIG. 11, the balancer 68 has a fluid coupling via a piston/gas spring 63 to the south side of the expander gas spring piston 28. For perfect balance the balancer displacement needs to be retarded with respect to the expander gas spring piston 28. This phasing requires a net transfer of power from the balancer assembly to the expander assembly and allows the balancer motor 65 also to control the operation (i.e. frequency and output) of the engine. The dynamics can be arranged such that without any power input to the balancer 68, the power output is reduced; whilst with the design input, balance is achieved with full power. Perfect balance may not generally be achieved for part loads but this is not a serious drawback for many applications Referring again to the embodiment of FIG. 9 it is noted that two electromagnetic transducers are provided. As mentioned above, linear suspension springs 54 are provided and in the embodiment shown the electromagnetic transducers 23 and 48 are themselves mounted between the linear suspension springs 54. The provision of electromagnetic transducers allows electrical energy to be input and output to and from the assemblies. In general, but not exclusively, the transducer 23 for the expansion assembly (first reciprocating assembly 60) will act predominantly or entirely as a generator. In general, but not exclusively, the transducer 48 for the compressor assembly (second reciprocating assembly 62) will act predominantly or entirely as a motor.

In the embodiment shown in FIG. 9, the north face of the expander gas spring piston 28 and the south face of the compressor gas spring piston 30 both act on the gas spring coupling volume 34 and provide the power transfer between the expander assembly (first reciprocating assembly 60) and the compressor assembly (second reciprocating assembly 62). The south face of the expander gas spring piston 56 drives a gas spring 72 that is dedicated to supplementing the spring rate for the expander assembly. Likewise the north face of the compressor gas spring piston 30 drives a gas spring 70 that is dedicated to supplementing the spring rate for the compressor assembly. The north sides of both pistons 28, 30 are stepped and have a smaller area because of the supporting shafts 74.

In an embodiment, the cross-sectional area of the supporting shaft 74 of the expander gas spring piston 28 is equal to the cross-sectional area of the expansion piston Pe. This helps to reduce variations in the size of dead volumes within the first reciprocating assembly, for example in the region of the transducer 23. Losses associated with pressure variations caused by reciprocating movement within the first reciprocating assembly can thereby be reduced. In an embodiment, the cross-sectional area of the supporting shaft 74 of the compressor gas spring piston 30 is equal to the cross-sectional area of the compression piston Pc. This helps to reduce variations in the size of dead volumes within the second reciprocating assembly, for example in the region of the transducer 48. Losses associated with pressure variations caused by reciprocating movement within the second reciprocating assembly can thereby be reduced.

Figure 12:
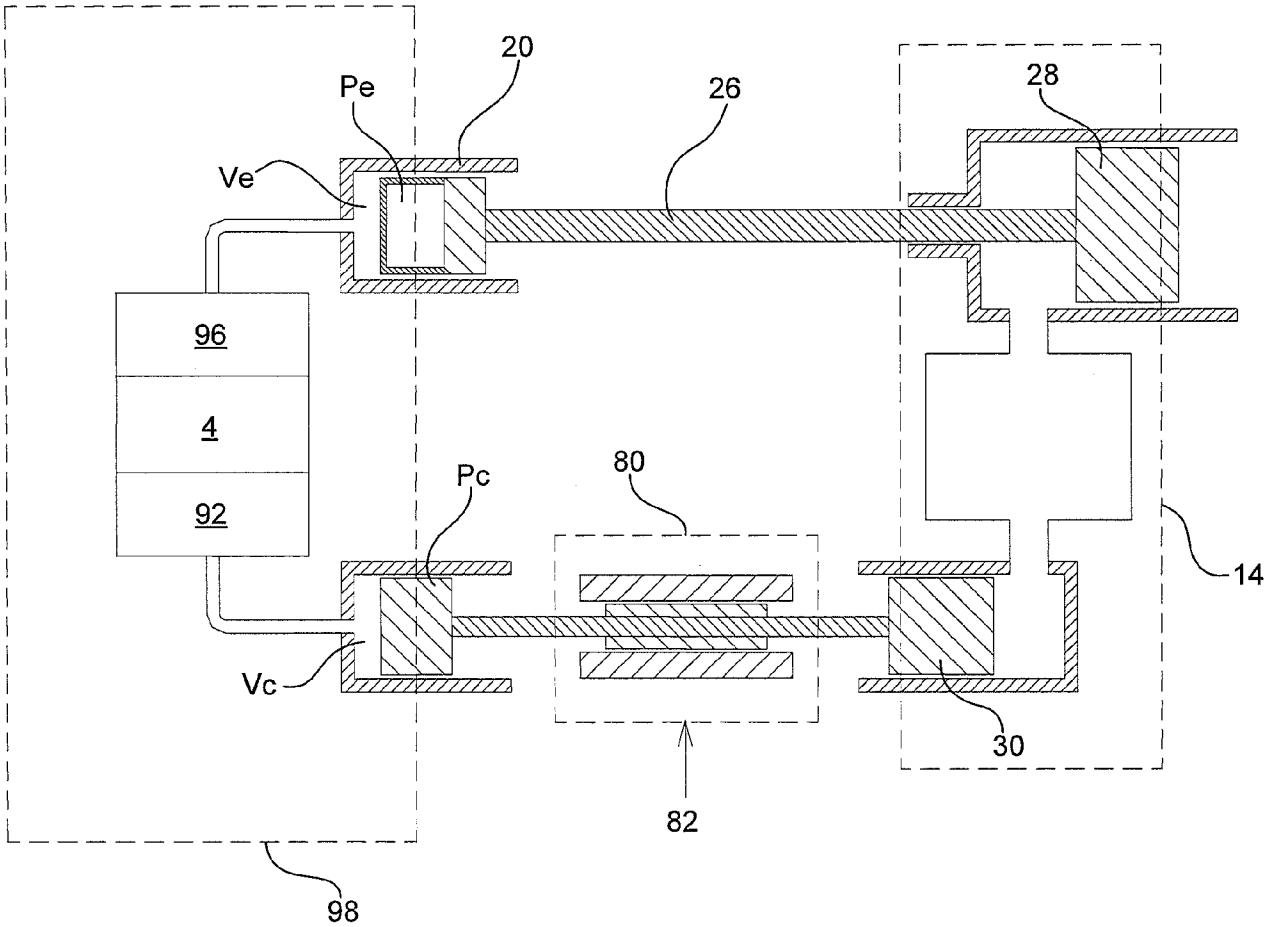
FIG. 12 depicts a Stirling cycle cooler.

Embodiments have so far been described with particular reference to Stirling engines—i.e. Stirling cycle machines that generate power. Any one of the described embodiments can also be applied singly or in combination to Stirling cycle machines that are used to pump heat e.g. coolers and heat pumps. FIG. 12 illustrates an example Stirling cycle cooler using such a configuration. The core Stirling cycle cooler components are depicted within broken line box 98. The arrangement is the same as that of FIG. 4 except that the component 96 corresponding to the "heater" operates at a lower temperature than the component 92 corresponding to the "cooler". The component 96 is therefore referred to as a heat acceptor 96 and the component 92 is referred to as a heat rejector 92. As in the embodiment of FIG. 4, first and second reciprocating assemblies are provided and coupled to a gas spring coupling 14. The gas spring coupling 14 transfers power between the first and second reciprocating assemblies without the need for a mechanical coupling mechanism. Operation is analogous to the embodiment of FIG. 4 except that now the entire expansion work is insufficient to drive the compressor assembly (second reciprocating assembly). In an embodiment a motor 80 is provided to add the necessary power input 82. There is no net output so a generator is not required. Problems of power control and synchronization encountered in engines are not relevant to coolers.

The detailed description given above with reference to FIG. 4 is largely applicable to the embodiment of FIG. 12 and corresponding features have been indicated with corresponding reference signs.

The embodiments described above comprise a gas spring coupling to transfer power between the compression and expansion volumes of the same engine. Further embodiments are possible where a gas spring coupling is used to transfer power from the expansion volume of one engine to the compression volume of another engine. Such an arrangement is illustrated in FIGS. 13-16.

Figure 13:
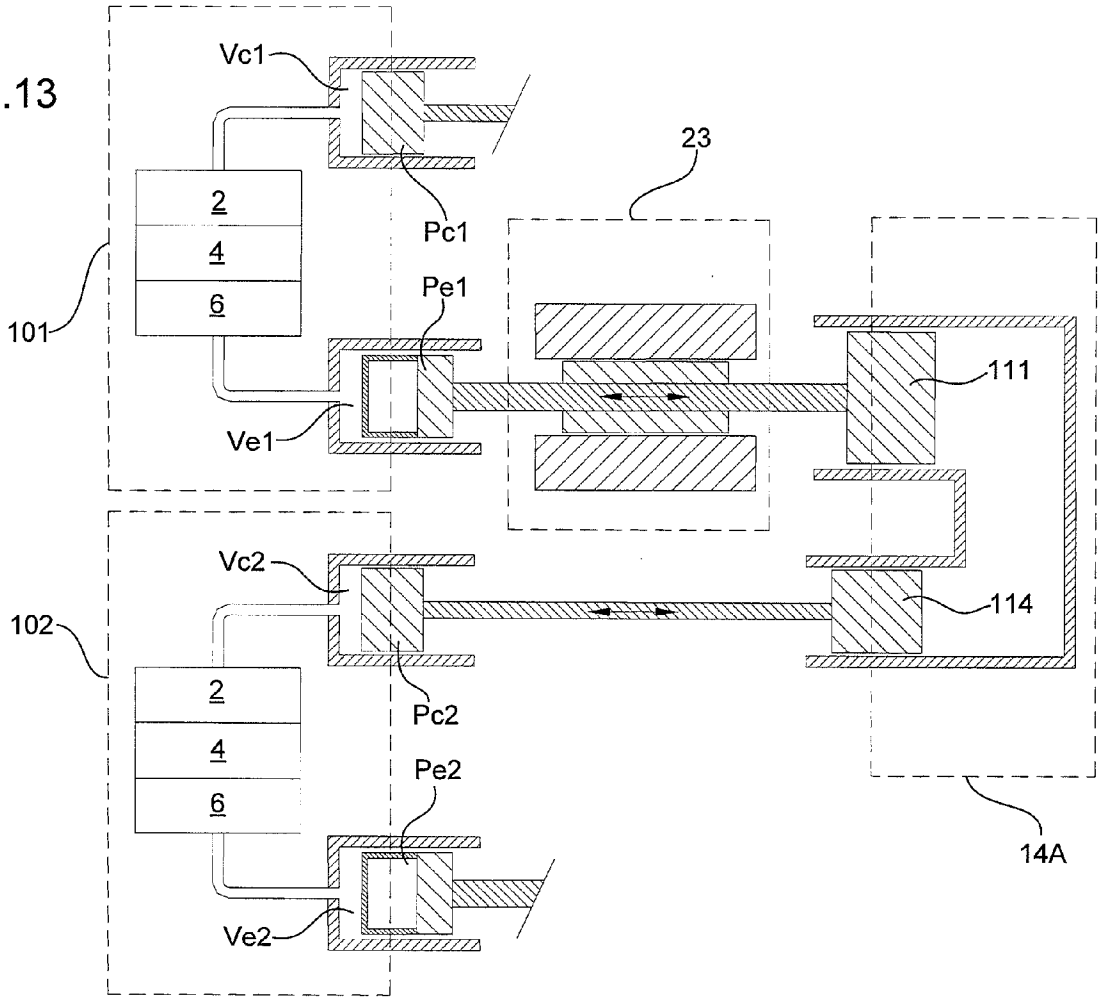
FIG. 13 depicts a multi-cylinder engine, in which two separate engine units are connected via two gas spring couplings.
Figure 16:
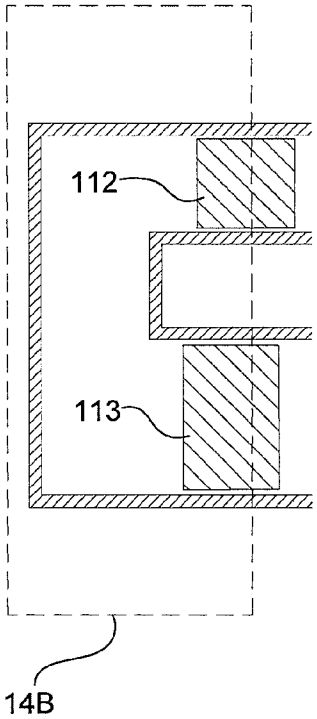
FIG. 16 is a side sectional view of the other of the gas spring couplings of the arrangement of FIG. 13.
Figure 15:
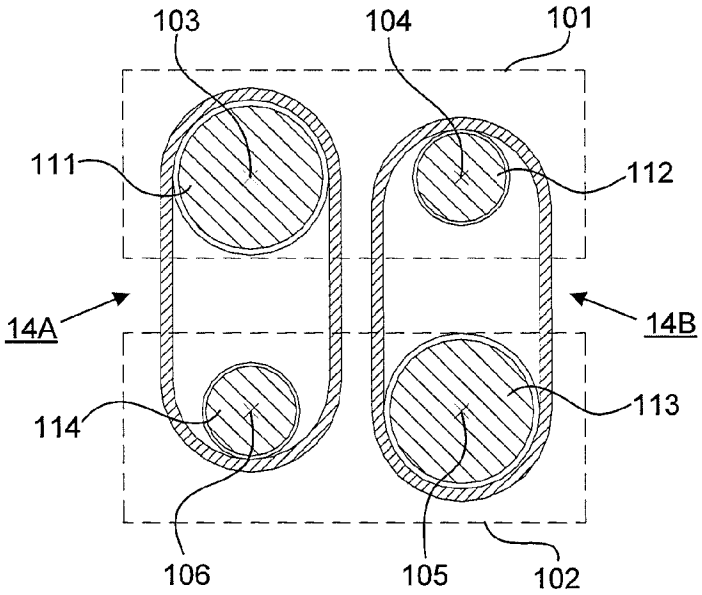
FIG. 15 is an end sectional view showing the two gas spring couplings of the arrangement of FIG. 13.
Figure 14:
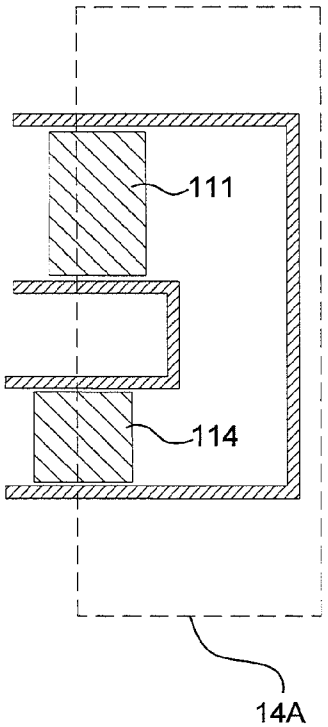
FIG. 14 is a side sectional view of one of the gas spring couplings of the arrangement of FIG. 13.

FIG. 13 shows schematically a "multi-cylinder" engine which has two alpha configuration Stirling engine units 101,102 coupled together with a phase angle between them of 180 degrees. FIG. 15 is an end sectional view depicting the two gas spring couplings 14A and 14B that connect the engine units 101,102 together. FIG. 14 is a side sectional view of the arrangement of FIG. 15 from the left-hand side, showing the gas spring coupling 14A connected to the expander gas spring piston 111 of the first engine unit 101 and the compressor gas spring piston 114 of the second engine unit 102. FIG. 16 is a side sectional view of the arrangement of FIG. 15 from the right-hand side, showing the gas spring coupling 14B connected to the compressor gas spring piston 112 of the first engine unit 101 and the expander gas spring piston 113 of the second engine unit 102. The geometry is essentially four-sided with alternate expander 103, 105 and compressor 104, 106 axes at each corner, as is seen in the end sectional view of FIG. 15.

In FIG. 13 the arrangement has been unwound to allow a 2 dimensional representation. The power flows in the overall engine are circular in that power is transferred from the expansion volume Ve1 of the first engine unit 101 to the compression volume Vc2 of engine unit 102 by means of the gas spring coupling 14A. Similarly power is transferred from the expansion volume Ve2 of engine unit 102 to the compression volume Vc1 of engine unit 101 by means of the gas spring coupling 14B. The gas spring coupling 14B is not shown in FIG. 13 but it will be understood that it completes the power transfer loop.

Arrangements of the type shown in FIG. 13 may be described in terms of two "sets" of the following elements: a gas spring coupling volume, first reciprocating assembly and second reciprocating assembly. The expander gas spring piston Pe1 of the first reciprocating assembly of the first set and the compressor gas spring piston Pc2 of the second reciprocating assembly of the first set are configured to reciprocate within the gas spring coupling volume 14A of the first set, and the expander gas spring piston Pe2 of the first reciprocating assembly of the second set and the compressor gas spring piston Pc1 of the second reciprocating assembly of the second set are configured to reciprocate within the gas spring coupling volume 14B (not shown in FIG. 13) of the second set. As can be seen, one of the engine units 101 is connected to the first reciprocating assembly of the first set and the second reciprocating assembly of the second set, and the other engine unit 102 is connected to the first reciprocating assembly of the second set and the second reciprocating assembly of the first set.

In an embodiment in which there is a phase difference of 180 degrees between the two engine units 101,102 there is no longer the need to introduce an extra phase difference by using different faces of the gas spring pistons 28,30 as was shown for single engine embodiments. For example, in the arrangement of FIGS. 13 to 16, the south face of expander gas spring piston 111 is connected via the gas spring coupling 14A to the south face of compressor gas spring piston 114. Likewise the south face of expander gas spring piston 113 is connected via gas spring coupling 14B to the south face of compressor gas spring piston 112. This feature has two very significant advantages; firstly the gas spring couplings 14A,14B have simpler and potentially cheaper, more efficient geometries; secondly the 180 degree phase shift between the engines results in equal and opposite volume variations in the various "dead" volumes (e.g. the volumes that surround the shaft/generator components; it is not intended that such volumes should undergo pressure variations as is necessary for the gas in the engine working volumes or the gas spring couplings) so that if they are all connected together there is no net volume variation and hence no pressure variation and minimal power loss.

The two engines units 101,102 shown in FIGS. 13-16 are not balanced; although corresponding components are in anti-phase, they are not aligned and result in a rocking couple. Good balance can be achieved by adding a mirror image that provides an opposite rocking couple for each moving component as has already been described above for the single unit engines. This will result in either a four unit engine—each unit with single compressor and expander pistons, or a two unit engine in which each compression and expansion space has two opposed pistons.

This can be done by either having two engine units opposed in a "boxer" formation as described above or alternatively by having two engine units side by side.

In a range of embodiments, a gas spring coupling is provided that transfers some power between one or more expansion and compression assemblies belonging to one or more alpha configuration Stirling cycle machines. The power transferred by the gas spring coupling can constitute the entire power transfer. Alternatively it can be part of the transfer with the rest being transferred by other means e.g. by electrical means to give some control of engine operation.

Figure 17:
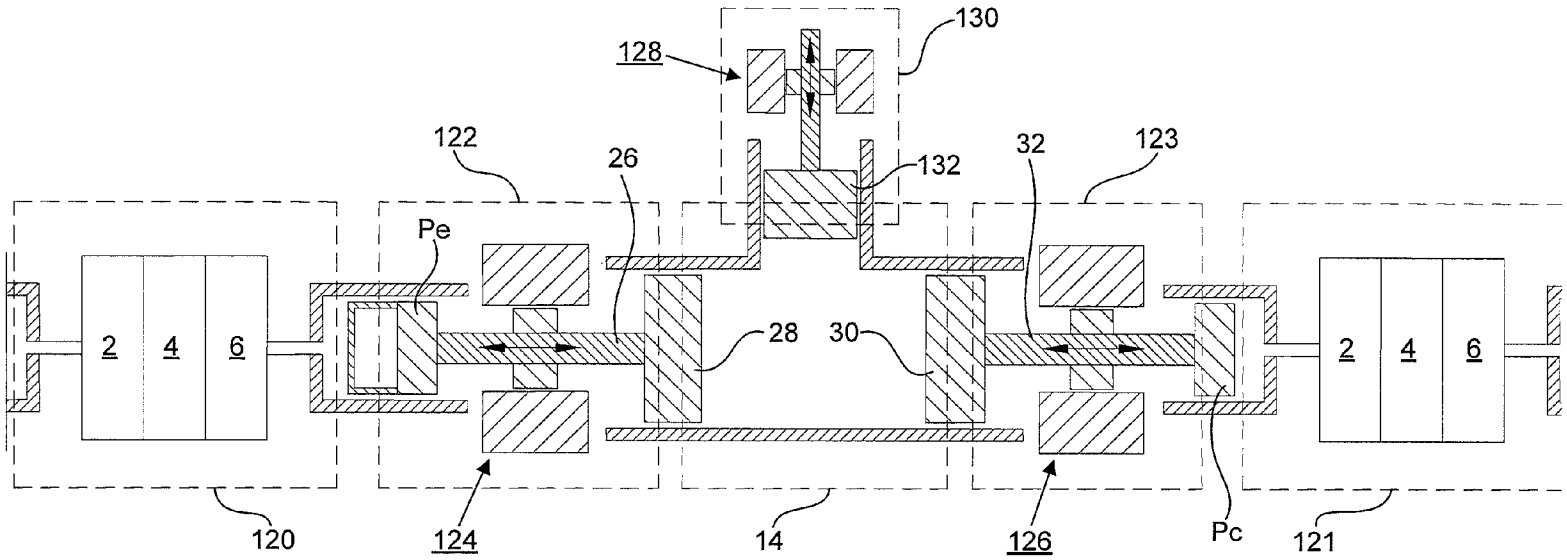
FIG. 17 depicts an open sequence of engine units.

The power transferred by the gas spring coupling can be between expansion volumes and compression volumes that belong to the same engine unit or alternatively it can be between separate engine units. The power transfers can be contained within loops. Alternatively, the power transfer can be part of an open sequence of engine units. FIG. 17 illustrates an example embodiment of this type. Here, a first alpha Stirling engine unit 120 is connected via an expansion assembly (first reciprocating assembly) 122 to a gas spring coupling 14. A second alpha Stirling engine unit 121 is also connected to the gas spring coupling volume 14, via a compressor assembly (second reciprocating assembly) 123. As in the embodiment described above with reference to FIG. 4 (in which the first and second reciprocating assemblies are connected to the same engine unit 16 rather than different engine units), the first reciprocating assembly 122 comprises an expansion piston Pe, an expansion coupling member 26 and an expander gas spring piston 28, and the second reciprocating assembly 123 comprises a compression piston Pc, a compression coupling member 32 and a compressor gas spring piston 30. In the embodiment shown, the first and second reciprocating assemblies 122,123 are each configured to interact with a transducer 124,126 (e.g. electromagnetic) for the input and/or output of power. In other embodiments, only one of the two transducers is provided (either one) or no transducer is provided.

In an embodiment, in addition to displacements associated with the expansion and compression assemblies (first and second reciprocating assemblies), the gas spring coupling is configured to accommodate additional displacements that modulate the operation of the gas spring and hence the engine. An example of such an arrangement is depicted in FIG. 17. Here, an optional spring modulating assembly 130 is provided for modulating operation of the engine, for example by adding or subtracting power. In an embodiment, the spring modulating assembly 130 comprises a modulating piston 132 and a modulating piston transducer 128 for allowing input and/or output of power. In an embodiment, the modulating piston driver 128 comprises an electromagnetic transducer. In an embodiment, the spring modulating assembly 130 is configured to operate as the principle power input and/or output to/from the engine. In an embodiment, the spring modulating assembly 130 is configured to perform the function of either or both of the transducers 124 and 126 and is provided instead of either or both of the transducers 124 and 126.

In an embodiment, a single gas spring coupling has inputs/outputs for single expansion and compression volumes. In other embodiments, a single gas spring coupling has multiple inputs/outputs for a plurality of expansion and/or compression volumes. In each case, the phases are configured to give the desired power flows. It is also possible to have multiple gas spring couplings operating in parallel.

In an embodiment, additional gas forces are used to input or output power from the assemblies. An example of such an embodiment was described above with reference to FIG. 11 where a balancer 68 also doubles as a power control mechanism. In an embodiment of the type shown in FIG. 17, unused sides of one or more of the various pistons could be incorporated into one or more additional power transfer mechanisms in a similar manner.

The invention claimed is:

1. A Stirling cycle engine, comprising:

an expansion volume structure defining an expansion volume;

a compression volume structure defining a compression volume;

a gas spring coupling volume structure defining a gas spring coupling volume;

a first reciprocating assembly comprising an expansion piston configured to reciprocate within the expansion volume and an expander gas spring piston rigidly connected to the expansion piston and configured to reciprocate within the gas spring coupling volume; and a second reciprocating assembly comprising a compression piston configured to reciprocate within the compression volume and a compressor gas spring piston rigidly connected to the compression piston and configured to reciprocate within the gas spring coupling volume, wherein:

the gas spring coupling volume structure and the first and second reciprocating assemblies are configured such that power is transferred in use from the expansion piston to the compression piston via the gas spring coupling volume, wherein the first and second reciprocating assemblies are configured such that, in use, movement of the expander gas spring piston is parallel to, but not coaxial with, movement of the compressor gas spring piston.

2. An engine according to claim 1, comprising:

a plurality of Stirling cycle engine units, each comprising a separate cooler-regenerator-heater system, wherein: the expansion volume is connected to the cooler-regenerator-heater system of one of the engine units and the compression volume is connected to the cooler-regenerator-heater system of a different one of the engine units.

3. An engine according to claim 1, comprising:

two sets of: a gas spring coupling volume, first reciprocating assembly and second reciprocating assembly, wherein:

the expander gas spring piston of the first reciprocating assembly of the first set and the compressor gas spring piston of the second reciprocating assembly of the first set are configured to reciprocate within the gas spring coupling volume of the first set; and the expander gas spring piston of the first reciprocating assembly of the second set and the compressor gas spring piston of the second reciprocating assembly of the second set are configured to reciprocate within the gas spring coupling volume of the second set.

4. An engine according to claim 3, wherein:

one of the engine units is connected to the first reciprocating assembly of the first set and the second reciprocating assembly of the second set; and a different one of the engine units is connected to the first reciprocating assembly of the second set and the second reciprocating assembly of the first set.

5. An engine according to claim 1, comprising:

a single cooler-regenerator-heater system for exchanging heat with gas flowing between the compression volume and the expansion volume.

6. An engine according to claim 1, wherein:

the gas spring coupling volume structure and first and second reciprocating assemblies are configured such that in use there is a net power transfer from the first reciprocating assembly into the gas spring coupling volume and a net power transfer from the gas spring coupling volume into the second reciprocating assembly.

7. An engine according to claim 1, wherein:

the expander gas spring piston comprises a surface facing into the gas spring coupling volume in the same direction as the direction of outward movement of the expansion piston; and the compressor gas spring piston comprises a surface facing into the gas spring coupling volume in the same direction as inward movement of the compression piston into the compression volume.

8. An engine according to claim 1, wherein:

the expander gas spring piston comprises a surface facing into the gas spring coupling volume in the direction opposite to the direction of outward movement of the expansion piston; and the compressor gas spring piston comprises a surface facing into the gas spring coupling volume in the direction opposite to the inward movement of the compression piston into the compression volume.

9. An engine according to claim 1, further comprising an expansion coupling member that is rigidly connected to the expansion piston and the expander gas spring piston.

10. An engine according to claim 9, wherein the expansion coupling member is configured to engage with a transducer for converting between energy associated with movement of the expansion coupling member and electrical energy.

11. An engine according to claim 10, wherein the expansion coupling member is configured to engage with the transducer at a position in between the expansion piston and the expander gas spring piston.

12. An engine according to claim 10, wherein the expander gas spring piston is between the expansion piston and a position at which the expansion coupling member engages with the transducer.

13. An engine according to claim 9, wherein the expansion coupling member comprises a linear shaft.

14. An engine according to claim 1, further comprising a compression coupling member that is rigidly connected to the compression piston and the compressor gas spring piston.

15. An engine according to claim 14, wherein the compression coupling member is configured to engage with a transducer for converting between energy associated with movement of the compression coupling member and electrical energy.

16. An engine according to claim 14, wherein the compression coupling member is configured to engage with the transducer at a position in between the compression piston and the compressor gas spring piston.

17. An engine according to claim 14, wherein the compression gas spring piston is between the compression piston and position at which the compression coupling member engages with the transducer.

18. An engine according to claim 14, wherein the compression coupling member comprises a linear shaft.

19. An engine according to claim 1, further comprising:

a controller for controlling one or more of the following: the power output by the engine, the amount of power transferred from the first reciprocating assembly to the second reciprocating assembly, the amplitude of the movement within the first reciprocating assembly and/or the second reciprocating assembly, the phase difference between the movements within the first and second reciprocating assemblies, the frequency of the movement of the first and second reciprocating assemblies.

20. An engine according to claim 19, wherein the controller is configured to receive input from a measurement device for measuring one or more of the following: the power output by the engine, the amount of power transferred from the first reciprocating assembly to the second reciprocating assembly, the amplitude of the movement within the first reciprocating assembly and/or the second reciprocating assembly, the phase difference between the movements within the first and second reciprocating assemblies, the frequency of the movement of the first and second reciprocating assemblies.

21. An engine according to claim 19, wherein the controller is configured to interact with a transducer within the first and/or second reciprocating assemblies.

22. An engine according to claim 1, further comprising a valve for venting the gas spring coupling volume.

23. An engine according to claim 1, wherein:

the first reciprocating assembly comprises a pair of axially aligned linear suspension springs that are configured to guide linear reciprocating movement of the expansion piston within a close-fitting bore and/or guide reciprocating movement of the expander gas spring piston within a close-fitting bore; and/or the second reciprocating assembly comprises a pair of axially aligned linear suspension springs that are configured to guide linear reciprocating movement of the compression piston within a close-fitting bore and/or guide reciprocating movement of the compressor gas spring piston within a close-fitting bore.

24. An engine according to claim 1, wherein:

the first reciprocating assembly comprises a first piston or first supporting shaft that is configured to reciprocate within a corresponding first bore formed within the gas spring coupling volume structure;

the first reciprocating assembly comprises a second piston or second supporting shaft that is configured to reciprocate within a corresponding second bore formed within the expansion volume structure; and the cross-sectional area of the first piston or first supporting shaft is equal to the cross-sectional area of the second piston or second supporting shaft.

25. An engine according to claim 1, wherein:

the second reciprocating assembly comprises a first piston or first supporting shaft that is configured to reciprocate within a corresponding first bore formed within the gas spring coupling volume structure;

the second reciprocating assembly comprises a second piston or second supporting shaft that is configured to reciprocate within a corresponding second bore formed within the compression volume structure; and the cross-sectional area of the first piston or first supporting shaft is equal to the cross-sectional area of the second piston or second supporting shaft.

26. An engine according to claim 1, comprising two sets of said first reciprocating assembly, said second reciprocating assembly, and said gas spring coupling volume structure, each set being arranged so that, in use, the position of the center of mass of the engine remains constant.

27. An engine according to claim 26, wherein the two sets are configured such that movement within one of the first reciprocating assemblies balances movement within the other first reciprocating assembly and movement within one of the second reciprocating assemblies balances movement within the other second reciprocating assembly.

28. An engine according to claim 26, wherein:

the two sets share a common heater-regenerator-cooler system comprising a single cooler, a single regenerator, and a single heater.

29. An engine according to claim 26, wherein:

the heater-regenerator-cooler system comprises a common heater and two sets of regenerator and cooler, the two expansion volumes being connected to the common heater, and each of the two compression volumes being connected to a different one of the two sets of regenerator and cooler.

30. An engine according to claim 26, wherein:

the heater-regenerator-cooler system comprises a common cooler and two sets of regenerator and heater, the two compression volumes being connected to the common cooler, and each of the two expansion volumes being connected to a different one of the two sets of regenerator and heater.

31. An engine according to claim 1, further comprising a third reciprocating assembly comprising a further compression piston configured to reciprocate within a further compression volume and a further compressor gas spring piston rigidly connected to the further compression piston and configured to reciprocate within the gas spring coupling volume, wherein:

the gas spring coupling volume structure and the first, second and third reciprocating assemblies are configured such that power is transferred from the expansion piston to the compression piston and/or the further compression piston via the gas spring coupling volume when the engine is outputting power.

32. An engine according to claim 31, wherein the first, second and third reciprocating assemblies are configured to reciprocate in mutually parallel or anti-parallel directions.

33. An engine according to claim 31, wherein the second and third reciprocating assemblies are positioned on opposite sides of the first reciprocating assembly and configured such that a resultant inertial force arising from movement within the second and third reciprocating assemblies acts along the axis of reciprocating movement within the first reciprocating assembly.

34. An engine according to claim 31, further comprising a balancer mass that is configured to act along the axis of reciprocating movement within the first reciprocating assembly.

35. An engine according to claim 1 further comprising:

a spring modulating assembly comprising a modulating piston movably mounted within the gas spring coupling structure, and a modulating piston transducer for allowing input and/or output of power via the modulating piston in order to modulate operation of the engine and/or input or output power to/from the engine.

36. A Stirling cycle cooler or heat pump, comprising:

an expansion volume structure defining an expansion volume;

a compression volume structure defining a compression volume;

a gas spring coupling volume structure defining a gas spring coupling volume;

a first reciprocating assembly comprising an expansion piston configured to reciprocate within the expansion volume and an expander gas spring piston rigidly connected to the expansion piston and configured to reciprocate within the gas spring coupling volume; and a second reciprocating assembly comprising a compression piston configured to reciprocate within the compression volume and a compressor gas spring piston rigidly connected to the compression piston and configured to reciprocate within the gas spring coupling volume, wherein:

the gas spring coupling volume structure and the first and second reciprocating assemblies are configured such that power is transferred in use from the expansion piston to the compression piston via the gas spring coupling volume, wherein the first and second reciprocating assemblies are configured such that, in use, movement of the expander gas spring piston is parallel to, but not coaxial with, movement of the compressor gas spring piston.

37. A cooler or heat pump according to claim 36, further comprising:

a heat acceptor-regenerator-heat rejector system for exchanging heat with gas flowing between the compression volume and the expansion volume.

38. An engine according to claim 1, comprising four or more Stirling cycle engine units.

* * * * *